US007963069B2

(12) United States Patent
Ropelato

(10) Patent No.: US 7,963,069 B2
(45) Date of Patent: Jun. 21, 2011

(54) SAFETY DEVICE FOR MOTORIZED ACCESS PASSAGEWAYS

(75) Inventor: Tomaso Ropelato, Trento (IT)

(73) Assignee: Gunnebo Entrance Control S.p.A., Lavis-Trento (IT)

( * ) Notice: Subject to any disclaimer, the term of this patent is extended or adjusted under 35 U.S.C. 154(b) by 367 days.

(21) Appl. No.: 11/921,093

(22) PCT Filed: May 30, 2006

(86) PCT No.: PCT/EP2006/005203

§ 371 (c)(1),
(2), (4) Date: Feb. 19, 2009

(87) PCT Pub. No.: WO2006/128694

PCT Pub. Date: Dec. 7, 2006

(65) Prior Publication Data

US 2009/0211158 A1 Aug. 27, 2009

(30) Foreign Application Priority Data

May 31, 2005 (IT) ..... VI2005A0164

(51) Int. Cl.
*E01F 13/00* (2006.01)

(52) U.S. Cl. ..... 49/49; 49/140

(58) Field of Classification Search ..... 49/49, 35, 49/139, 140, 141

See application file for complete search history.

(56) References Cited

U.S. PATENT DOCUMENTS

| | | | | | |
|---|---|---|---|---|---|
| 1,875,771 | A * | 9/1932 | Stewart | 49/26 |
| 3,386,202 | A * | 6/1968 | Crews et al. | 49/35 |
| 3,478,467 | A * | 11/1969 | May | 49/35 |
| 3,606,698 | A * | 9/1971 | Tanaka et al. | 49/35 |
| 3,633,311 | A * | 1/1972 | Ulmann | 49/35 |
| 3,742,647 | A * | 7/1973 | Tomita | 49/35 |
| 4,155,199 | A * | 5/1979 | Rubertus | 49/141 |
| 4,472,908 | A * | 9/1984 | Wanzl et al. | 49/25 |
| 4,658,543 | A * | 4/1987 | Carr | 49/139 |
| 5,136,810 | A * | 8/1992 | DeWitt, III | 49/49 |
| 2006/0101716 | A1 * | 5/2006 | Vandyck et al. | 49/35 |

FOREIGN PATENT DOCUMENTS

| | | | |
|---|---|---|---|
| EP | 0644309 | A | 3/1995 |
| GB | 2047328 | A * | 11/1980 |

OTHER PUBLICATIONS

International Search Report, Aug. 14, 2006.

* cited by examiner

*Primary Examiner* — Jerry Redman

(74) *Attorney, Agent, or Firm* — Hedman & Costigan, P.C.; James V. Costigan

(57) ABSTRACT

A safety device for motorized pedestrian access passageways, comprising a movement and supporting mechanism of an oscillating access shutter, which includes an electric motor (30) for activating the shutter, and a mechanical control system, which uses a series of levers (12, 13, 14, 14'), associated with respective elastic elements (22, 25), and a pushing element (31), suitable for allowing the automatic opening of the passageway, in the case of a lack of power supply, due, for example, to an electric black-out; in particular, the position in which the shutter almost completely closes the access passageway is an unstable equilibrium position, which is maintained thanks to the action of an electric motor (30), with an incorporated reducer, which contrasts the opening movement of the shutter, and the pushing element (31), which intervenes in the opening, when the shutter is positioned for completely closing the passageway.

12 Claims, 2 Drawing Sheets

SAFETY DEVICE FOR MOTORIZED ACCESS PASSAGEWAYS

The present invention relates in general to a safety device for motorized access passageways, such as those used for controlling the passage of persons in places such as subways, airports, factories, offices, etc.

More specifically, the invention relates to a safety device, of the purely mechanical type, suitable for allowing the automatic opening of oscillating shutters, which normally close said access passageways, when there is a lack of power supply (due, for example, to a black-out), in order to allow the passage of people in potentially dangerous situations.

Current movement devices of oscillating shutters of motorized access passageways still use alternate or direct current electric motors, which, by means of a reducer, activate a mechanism which sustains the shutter and makes it move perpendicularly to the passage direction, in order to open or close the passageway.

The movement of the shutter preferably takes place along a circumference arc, centered on the vertical, so that the anticlockwise rotation of an electric motor allows the complete opening of the passageway, by the reentry of the shutter itself, whereas with a clockwise rotation of the motor, the closing of the passageway is obtained, by the extension of the shutter.

The activation logic of traditional movement devices varies according to the specific application and envisages the possibility of opening the passageway normally closed, after suitable access means (as in the case of subways), or closing the passageway normally open, in the case of the detection of an error condition (as in the case of access passageways connected to a metal detector).

The movement devices currently used and described so far, however, have numerous series drawbacks, if there is an interruption in the power supply, due, for example, to a black-out.

In this case, devices using any type of electric motors for activation are no longer capable of functioning, if they are not connected to a battery or a continuity group or other electric energy reserves (condensers).

It is evident, however, that equipment such as a set of accumulators and/or a continuity group creates considerable encumbrance and high installation, operating and maintenance costs.

In order to avoid the use of a battery for reserve supply, some activation devices of the known type use a counterweight which is lifted during the closing of the oscillating shutters to give them sufficient potential energy for activating the opening mechanism, in the case of a black-out; alternatively, the counterweight is lifted during the opening of the sliding shutters in order to activate the closing mechanism, in the case of a black-out.

It is also possible to arrange the counterweight so as to effect a functioning cycle regardless of the position of the shutter movement device when there is a lack of power supply, i.e. opening the passageway if it was closed before the black-out and/or closing it if it was open.

The presence of a counterweight, however, also creates considerable encumbrances of the overall structure and implies a consistent increase in the production costs of the movement device.

An objective of the present invention is therefore to overcome the above drawbacks and, in particular, to provide a safety device for motorized access passageways, which allows an automatic opening of passageways to be effected in the absence of a power supply (due, for example, to a black-out), in order to allow the passage of people in potentially dangerous situations.

A further objective of the present invention is to provide a safety device for motorized access passageways, of the purely mechanical type, which also has antivandalism characteristics, preventing however the passage of persons under passageway control conditions.

Another objective of the invention is to provide a safety device for motorized access passageways, which is extremely practical, safe, functional and reliable, and also economical, in terms of production and operating costs, also in consideration of the advantages provided.

These objectives, according to the present invention, are achieved by providing a safety device for motorized access passageways, according to claim 1 enclosed.

The device, object of the invention, advantageously allows a functioning cycle to be effected after a black-out, when the oscillating shutters of the access passageway are in a closed position at the moment in which there is a lack of power supply.

Furthermore, the absence of a counterweight and/or set of accumulators or continuity group for the functioning of the device, causes an overall reduction in the encumbrance of the structure and a considerable saving in economical terms, with respect to the known solutions.

Further characteristics and advantages of a safety device for motorized access passageways, according to the present invention, will appear more evident from the following illustrative and non-limiting description, referring to the enclosed schematic drawings, in which.

Figure 1:
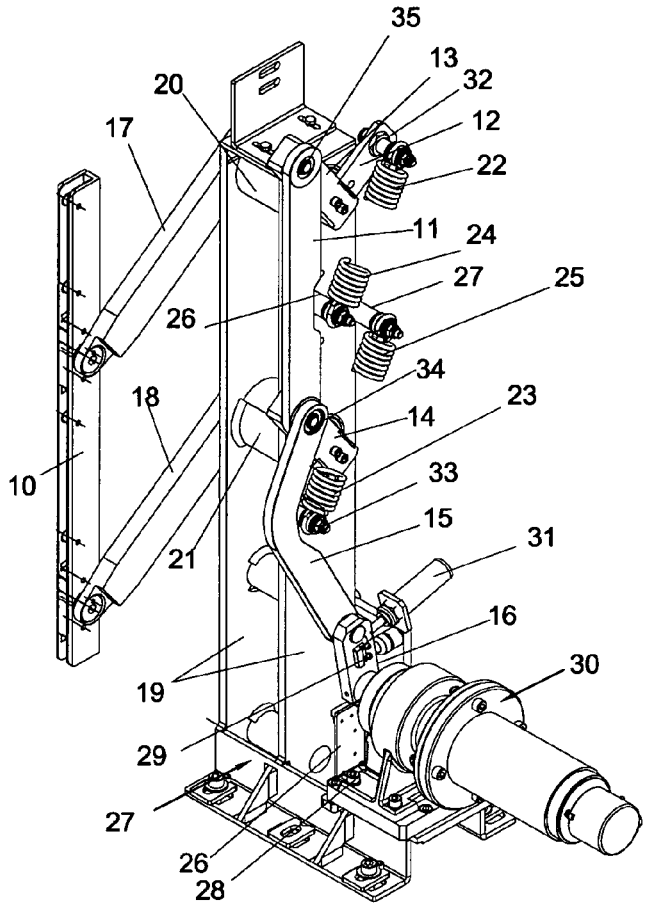
FIG. 1 is a perspective view of the safety device for motorized access passageways, according to the present invention.

With reference to the above figures, the safety device for motorized access passageways, according to the present invention, comprises a movement and supporting mechanism of the oscillating shutter (not illustrated in the figures), which is fixed to the supporting rod 10.

Said mechanism, illustrated in the enclosed figures in a rest position, i.e. with the shutter closed or almost completely closed, comprises a jointed system consisting of a rod 11, levers 12, 13, 14, 14', a shaped connecting rod 15, moved by a handle 16, and by a pair of upper 17 and lower 18 movement arms, respectively, hinged to the supporting rod 10 of the sliding shutter. The levers 12, 13, 14, 14' are centrally hinged on one side to a supporting structure 19, which, in turn, is fixed on a base section bar 27 and supports, on the opposite side, the arms 17, 18, which are fitted in correspondence with the same pins 20, 21 of the levers, respectively 12, 13 and 14, 14', so as to rotate integrally therewith.

The lever 13 is fulcrumed in 35, in correspondence with one end, to the arm 11 and is hinged to the lever 12 in correspondence with the opposite end, so as to form, in a rest position, with the shutter closed, an acute angle having a pre-established measurement; in particular, the lever 12, in a rest position, is aligned with the axis of the arm 17, and a pin 32, which carries the end of a spring 22, is constrained thereto, in correspondence with one end.

Analogously, the lever 14 is fulcrumed in 34 to the connecting rod 15 and the arm 11, in correspondence with the same end, and is also hinged to the lever 14' in correspondence with the opposite end; furthermore, the lever 14', in a closed shutter position, is aligned with the axis of the arm 18 and a pin 33, which carries the end of a spring 25, is constrained thereto, in correspondence with one end.

The ends of the springs 22, 25 are fixed, by means of respective pins 26, 27, to the central structure 19 in pre-established positions; in particular, the springs 22, 25 are situated on the structure 19 in symmetrical and opposite positions, with respect to a central axis X (in the enclosed figures the springs 22, 25 are interrupted for purely graphical reasons).

At the base of the structure 19, a plate 26 is positioned vertically, which, in correspondence with the upper and lower run-end of the handle 16, carries a buffer 28 and a microswitch 29, for detecting the position of the handle 16 by acting on the activation motor, generically indicated with 30.

The motor 30 can be of the direct current or alternate current type and incorporates a reducer.

It should also be noted that the outlet shaft of the motor 30, on which the handle 16 is fitted, is situated perpendicularly to the axis X of the structure 19 and that the shaped connecting rod 15 has a conformation which is such that the measurement of the angle formed by the line which joins the fulcrum 34 with the insertion point of the outlet shaft of the motor 30 on the handle 16 and the above central axis X of the supporting structure 19, is pre-established and appropriate.

This particular arrangement of elements ensures that the movement of the oscillating shutter creates a symmetrical oscillation, with respect to the axis X, of the levers 12, 13, 14, 14' and arms 17, 18.

According to the invention, there is also the presence of a pushing element 31, which acts, for a pre-established angle, on the handle 16 of the jointed movement structure of the shutter, actuating a pushing function on the handle itself and accompanying it in such a position as to allow its spontaneous rotation (leaving the negative rotation position).

Figure 2:
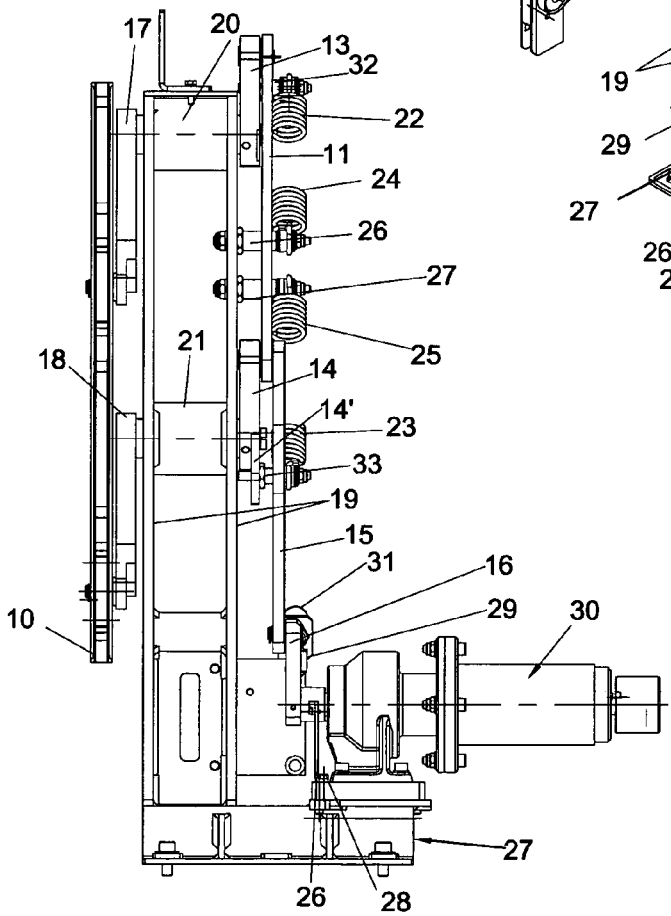
FIG. 2 is a side view of the safety device of FIG. 1, according to the present invention.
Figure 3:
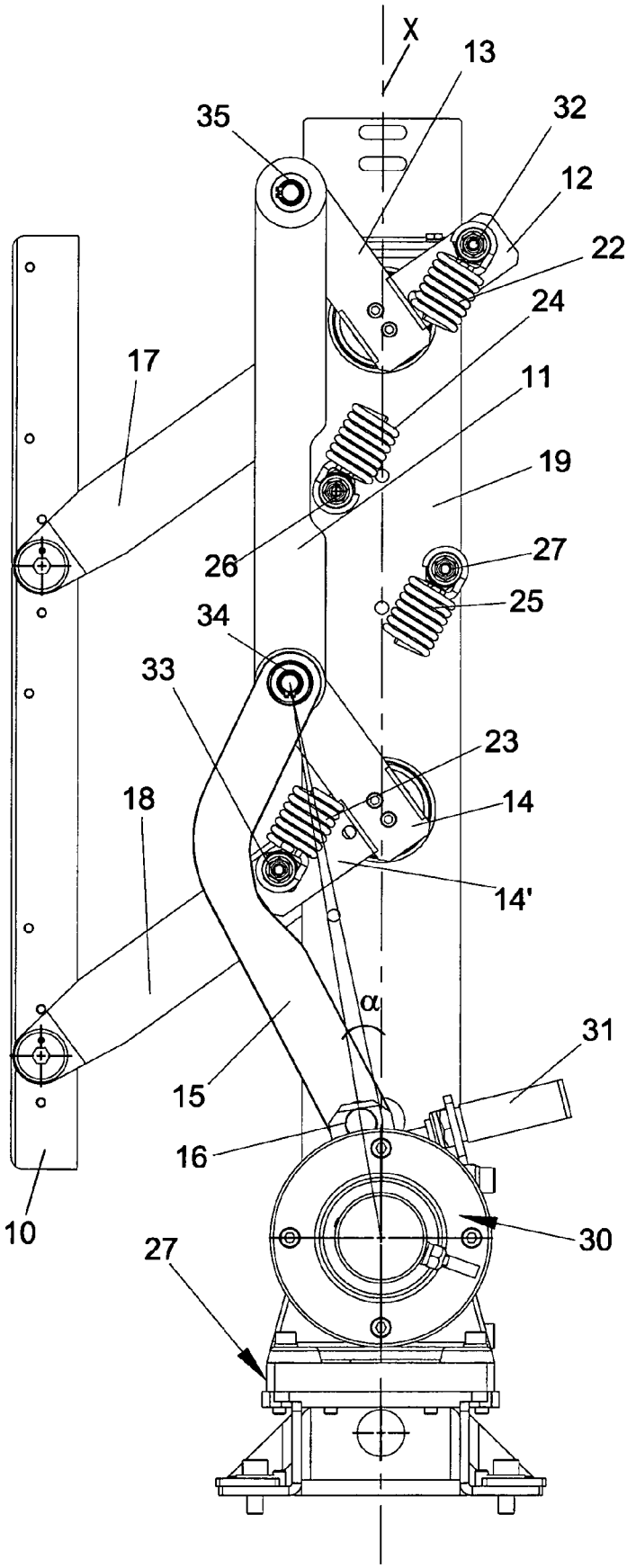
FIG. 3 is a further side view of the safety device of FIG. 1, according to the present invention.

In the position defined in FIGS. 1-3 enclosed, the handle 16 is positioned slightly before its upper run-end and the shutter is extended so as to almost completely close the passageway.

The position illustrated, with the shutter almost completely closing the passageway, is a position of unstable equilibrium which is maintained thanks to a mechanical control system based on the action of the motor 30 and incorporated reducer, which contrasts the opening movement of the shutter, whose weight favours its lowering and the consequent rotation of the opening arms 17, 18, due to the translation of the elastic elements, such as the springs 22, 25; furthermore, as already mentioned, in this case, the action of the motor 30 is also in equilibrium (unstable) with the pushing action of the element 31 (functioning in the final part of the rotation) on the handle 16, also suitable for causing the rotation of the arms 17, 18 and the consequent lowering of the oscillating shutter for the opening of the passageway.

All this takes place under normal conditions in the presence of the power supply.

Finally, again under normal conditions in the presence of the power supply, when the oscillating shutter must be withdrawn for opening the passageway, the motor 30 rotates the handle 16 in an anticlockwise direction, and with it, the whole jointed structure comprising the arm 11, the levers 12, 13, 14 and 14', the arms 17, 18 and the supporting rod 10 of the sliding shutter, by means of the shaped connecting rod 15.

It is therefore obvious that, when there is a lack of power supply, due, for example, to a black-out, the motor 30 no longer guarantees the above unstable equilibrium position and consequently, when the sliding shutter is not completely extended, the arms 17, 18 rotate thanks to the translation of the elastic elements 22, 25 and the automatic and purely mechanical re-entering of the shutter and opening of the passageway are consequently effected.

When the shutter is completely extended, totally closing the passageway, the action of the pushing element 31 is used, which is functioning and which creates a pushing movement for activating the handle 16 from the equilibrium position.

This, in fact, causes the connecting rod 15 to shift from an equilibrium position and, as described above, with the consequent automatic rotation of the arms 17, 18, the shifting of the shutter, which is withdrawn inside the structure 19, and the instantaneous and automatic opening of the access passageway.

The particular structure of the mechanical control system used, also provides a safe motorized access passageway against any attempts at vandalism, as, under control conditions (i.e. under normal functioning conditions, in the absence of a black-out and with the shutter oscillating to completely close the access passageway), the motor 30 keeps the handle 16 at run-end, which, by overcoming the action of the pushing element 31, keeps the shutter in a closed position, preventing the passage of persons in correspondence with the access passageway and causing a decisive resistance to forced and/or fraudulent manual opening of the sliding shutter.

Finally, it is also evident that, when the present device is connected to a continuity group suitable for feeding the pushing element 31, in this case of an electromagnetic nature, it can essentially consist of one or more batteries, instead of a more complicated and costly generator, necessary for activation under emergency conditions of the known devices.

The characteristics of the safety device for motorized access passageways, object of the present invention, appear clear from the above description, as also the advantages.

Finally, numerous other variants can obviously be applied to the safety device in question, all included in the novelty principles of the inventive concept. It is also evident that, in the practical embodiment of the invention, the materials, forms and dimensions of the details illustrated can vary according to the demands and can be substituted with other technically equivalent alternatives.

The movement and supporting mechanism of the oscillating shutter, for example, can be obtained with any equivalent of the mechanism described and illustrated, provided it is activated by the direct or alternate current electric motor 30, of the type described above; analogously, the springs 22, 25 can be replaced by general elastic elements suitable for the purpose.

The invention claimed is:

1. A safety device for motorized access passageways, comprising a movement and supporting mechanism of an oscillating access shutter, which includes an electric motor (30) having an outlet shaft, said electric motor (30) being suitable for activating, by means of at least one reducer, a mechanical control system, which supports the shutter and makes said oscillating access shutter oscillate, along a circumference arc, perpendicularly to a passage direction, so as to open or close an access passageway, because of a swinging movement of said oscillating access shutter which, following a first rotation causes closing of the access passageway and following a subsequent rotation, opposite with respect to said first rotation, causes opening of the access passageway, characterized in that said mechanical control system comprises at least one shaped connecting rod (15), fitted, by means of at least one handle (16), onto the outlet shaft of said electric motor (30), said shaped connecting rod (15) also being connected to at least one vertical arm (11) having ends said vertical arm (11) being fulcrumed, in correspondence with said ends of said one vertical arm (11), to a plurality of levers (12, 13, 14, 14'), characterized in that at least two of said levers (12, 13, 14, 14') are mutually connected in correspondence of each of said ends of said vertical arm (11), said two levers (12, 13, 14, 14') being centrally hinged, on each other, by means of a first connection pin (20, 21), onto a supporting structure (19) along a central axis (X) of said supporting structure (19), at least a second pin (32,33), which carries at least one elastic element (22, 25), being fixed to at least one of said hinged levers (12, 13, 14, 14').

2. The safety device according to claim 1, characterized in that said first connection pins (20, 21) are connected to respective tilting movement arms (17, 18) of a supporting rod (10) of the oscillating shutter suitable for opening or closing the access passageway, so that said movement arms (17, 18) rotate integrally with said levers (12, 13, 14, 14').

3. The safety device according to claim 2, characterized in that at least one (12, 14) of said pairs of levers (12, 13, 14, 14'), in rest position, with the shutter closed or almost completely closed, is aligned with an axis of at least one of said tilting movement arms (17, 18) of the shutter.

4. The safety device according to claim 1, characterized in that said pairs of levers (12, 13, 14, 14') are hinged to each other in correspondence with their ends, so as to form, in a rest position, with the shutter closed or almost completely closed, a pre-established measurement angle.

5. The safety device according to claim 1, characterized in that said supporting structure (19) carries, in fixed positions, hooks on said elastic elements (22, 25), fixed to the structure (19) by means of respective third pins (26, 27).

6. The safety device according to claim 5, characterized in that said elastic elements (22, 25) are arranged, on the supporting structure (19), in symmetrical and opposite positions, with respect to a central axis (X).

7. The safety device according to claim 6, characterized in that said outlet shaft of the electric motor (30) is situated perpendicularly to the central axis (X) of said supporting structure (19).

8. The safety device according to claim 1, characterized in that said connecting rod (15) is shaped so that an angle formed by a line which joins connection point (34) of the connecting rod (15) with the vertical arm (11) with an insertion point of the outlet shaft of the motor (30) on the handle (16) and said central axis (X) of the supporting structure (19), is pre-established.

9. The safety device according to claim 1, characterized in that at least one pushing element (31) acts on said handle (16) of a jointed movement structure of a sliding shutter, acting within a range of a limited angle.

10. The safety device according to claim 9, characterized in that action of said electric motor (30) and said pushing element (31) maintains a position of unstable equilibrium of the mechanical control system, said position corresponding to a closing position of the access passageway on a part of the sliding shutter.

11. The safety device according to claim 10, characterized in that an opening movement of the sliding shutter is caused by an automatic and purely mechanical rotation of the tilting arms (17, 18), following a translation movement of said elastic elements (22, 25), when there is a lack of power supply.

12. The safety device according to claim 9, characterized in that action of the connecting rod (15) and the handle (16) keeps the oscillating access shutter in a closing position of the access passageway, preventing passage of persons in correspondence with said access passageway and causing a resistance action to forced or fraudulent manual opening of the sliding shutter.

* * * * *